United States Patent [19]

Rushman

[11] 4,117,869

[45] Oct. 3, 1978

[54] OIL MIST LUBRICATED TEXTILE MACHINE AND METHOD

[75] Inventor: Reginald Rushman, Lymm, England

[73] Assignee: Parks-Cramer (Great Britain) Ltd., London, England

[21] Appl. No.: 798,935

[22] Filed: May 20, 1977

[51] Int. Cl.[2] ..... D03J 1/00

[52] U.S. Cl. ..... 139/1 R; 139/45; 139/438

[58] Field of Search ..... 139/1 R, 1 C, 45, 437, 139/438, 439, 142; 112/256; 184/6.25, 6.26, 6.27

[56] References Cited

U.S. PATENT DOCUMENTS

| | | | |
|---|---|---|---|
| 2,691,428 | 10/1954 | Thomas | 184/6.26 |
| 3,221,775 | 12/1965 | Boley et al. | 139/45 |
| 4,003,409 | 1/1977 | Steffens | 139/45 |
| 4,018,303 | 4/1977 | White et al. | 184/6.26 |

*Primary Examiner*—Henry S. Jaudon

*Attorney, Agent, or Firm*—Bell, Seltzer, Park & Gibson

[57] ABSTRACT

An apparatus and method for reducing contamination of areas ambient to a textile machine such as a machine having fabric forming instrumentalities for forming textile strand materials into fabric and a lubrication system for the fabric forming instrumentalities. In accordance with the present invention, an airstream is induced to flow adjacent the fabric forming instrumentalities, fine particles of lubricant are entrained in the airstream and conveyed thereby from the area of the fabric forming instrumentalities, and the lubricant is subsequently collected from the airstream.

15 Claims, 6 Drawing Figures

OIL MIST LUBRICATED TEXTILE MACHINE AND METHOD

Textile fabrics conventionally are formed by supplying selected textile strand materials to a machine having fabric forming instrumentalities and manipulating the textile strand materials. In the specific instance of woven fabrics, textile fabric weaving machines have weaving instrumentalities for interweaving strand materials by forming warp yarns into sheds and inserting weft yarns into the sheds. The weft yarn inserting portions of the weaving instrumentalities are herein referred to as picking instrumentalities.

Certain textile fabric forming machines, and particularly weaving machines having certain types of picking instrumentalities, are provided with means for lubricating the fabric forming instrumentalities during operation of the machine. Particularly where picking instrumentalities are lubricated with airborne fine particles of lubricant, supplied for example in the form of an oil mist, areas ambient to the fabric forming machine are subject to contamination by the lubricant. In some weaving sheds, where significant numbers of weaving machines are used, oil mist fogs the atmosphere of the shed. Such a fog of airborne fine particles of lubricant presents difficulty by contaminating woven fabric being produced and by causing undue accumulations of lint and fly fiber and by requiring that operatives tending the weaving machines work under unfavorable conditions.

Recognizing the difficulties created by prior textile fabric forming machines having means for lubricating fabric forming instrumentalities, it is an object of the present invention to minimize contamination by lubricant of areas ambient to a textile fabric forming machine having lubricated fabric forming instrumentalities. In realizing this object of the present invention, an airstream is induced to flow adjacent the fabric forming instrumentalities and airborne fine particles of lubricant are entrained in the airstream to be conveyed from the location of the fabric forming instrumentalities. At a location spaced from the fabric forming instrumentalities, the fine particles of lubricant entrained in the airstream are collected therefrom.

Yet a further object of the present invention is to improve the quality of air in a weaving shed. In realizing this object of the present invention, each of a plurality of textile fabric weaving machines disposed in a weaving shed is equipped with means mounted on the machine for inducing an airstream to flow adjacent lubricated weaving instrumentalities of the machine. The airstream is cleaned by removing therefrom and collecting lubricant which has been entrained therein, before returning the air to the weaving shed, thereby controlling contamination of areas ambient to the weaving machines by airborne fine particles of lubricant.

Yet a further object of the present invention is to equip a textile fabric weaving machine with a hood through which an airstream is induced to flow from a localized area adjacent picking instrumentalities of the weaving machine. In accordance with the present invention, airborne fine particles of lubricant supplied to the picking instrumentalities by an oil mist lubrication system are entrained in the airflow and conveyed to an electrostatic filter at which conveyed fine particles of lubricant are removed from the airstream.

Some of the objects of the invention having been stated, other objects will appear as the description proceeds, when taken in connection with the accompanying drawings, in which FIG. 1 is an end elevation view of a textile fabric forming machine in accordance with the present invention;

Figure 1:
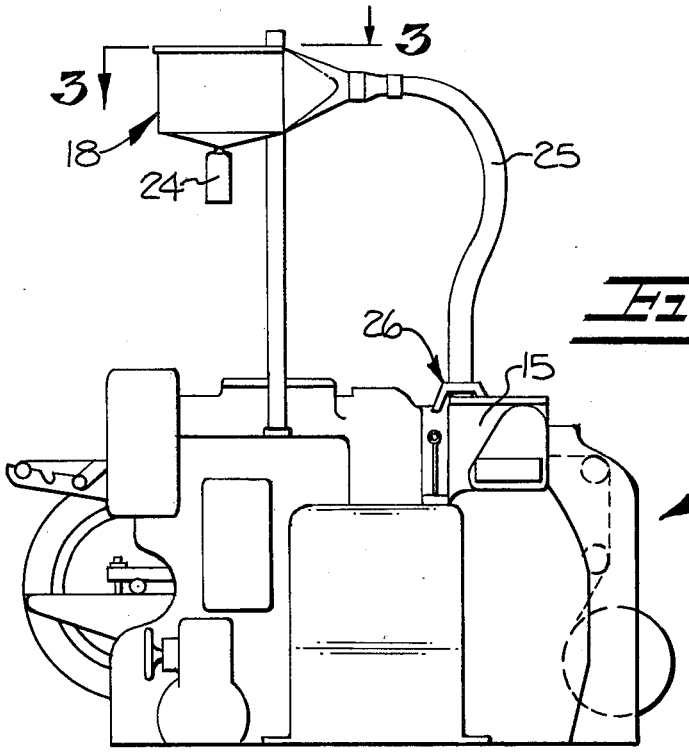
Figure 2:
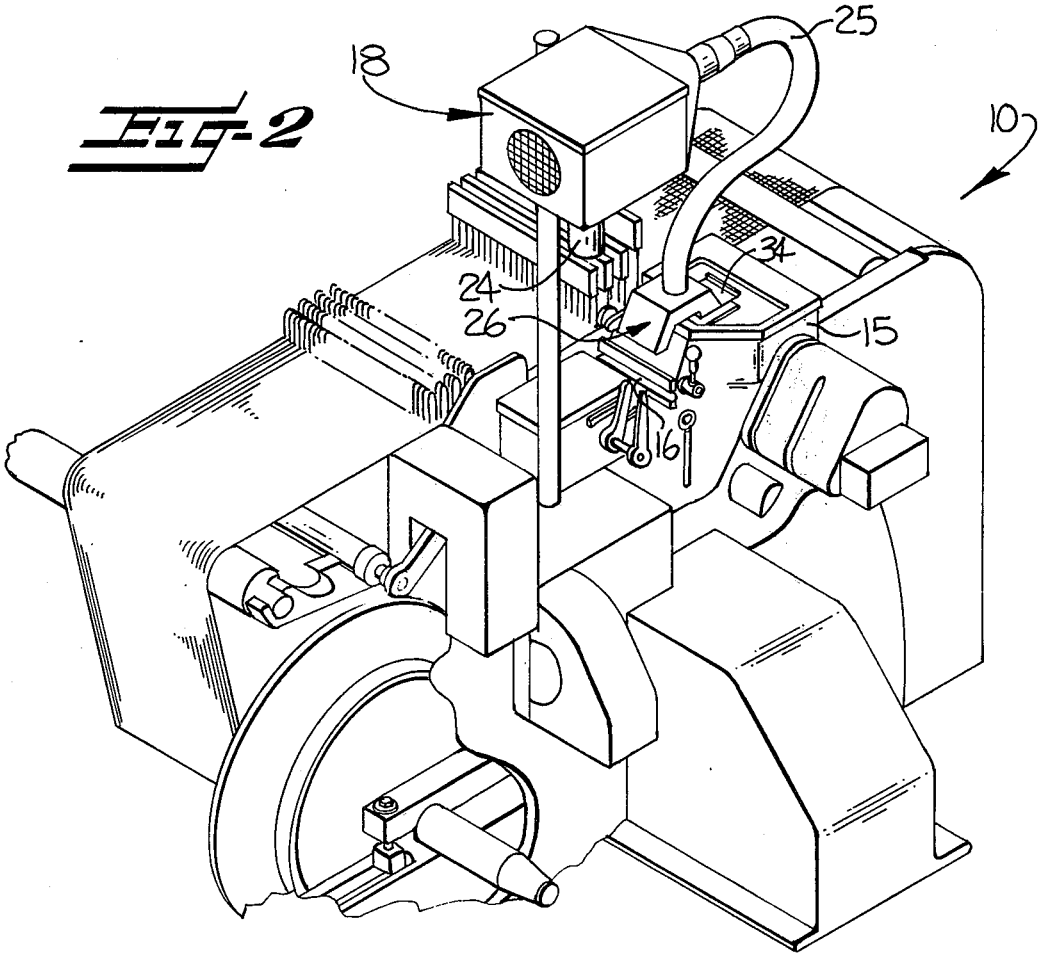
FIG. 2 is a perspective view of the fabric forming machine of FIG. 1, particularly showing certain elements of the arrangement of the present invention.
Figure 3:
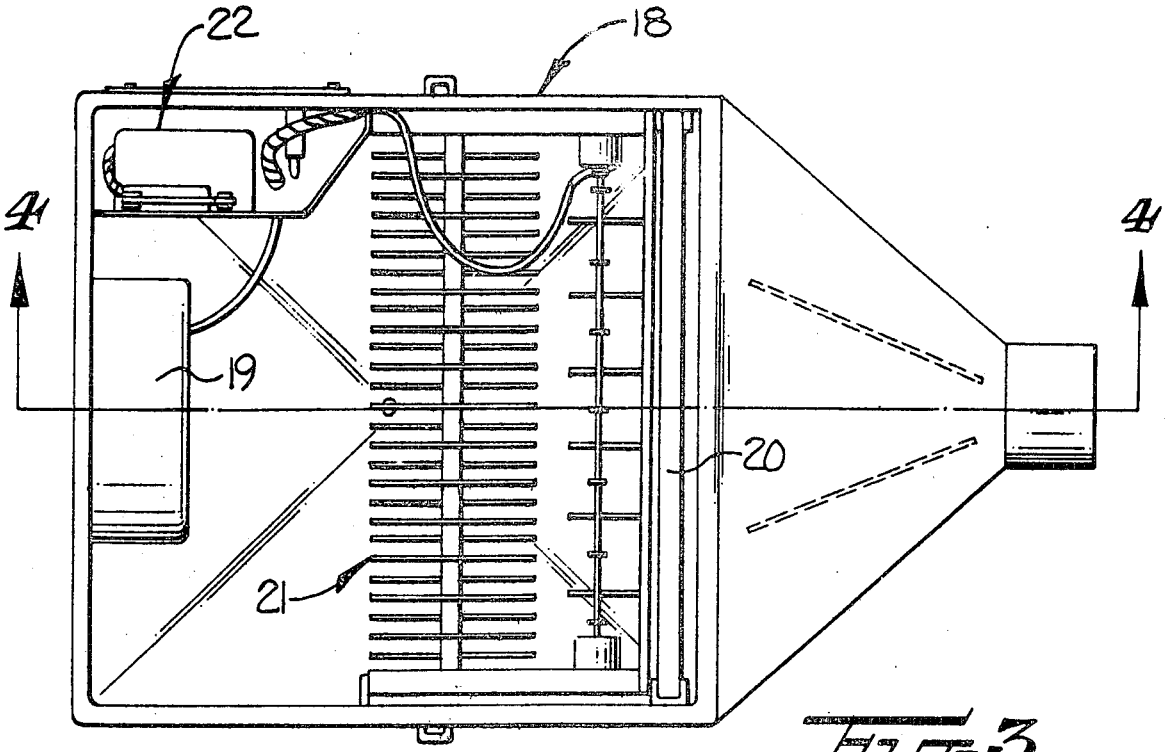
FIG. 3 is a plan view of a portion of the apparatus of FIGS. 1 and 2, taken generally as indicated by the Line 3—3 in FIG. 1.
Figure 4:
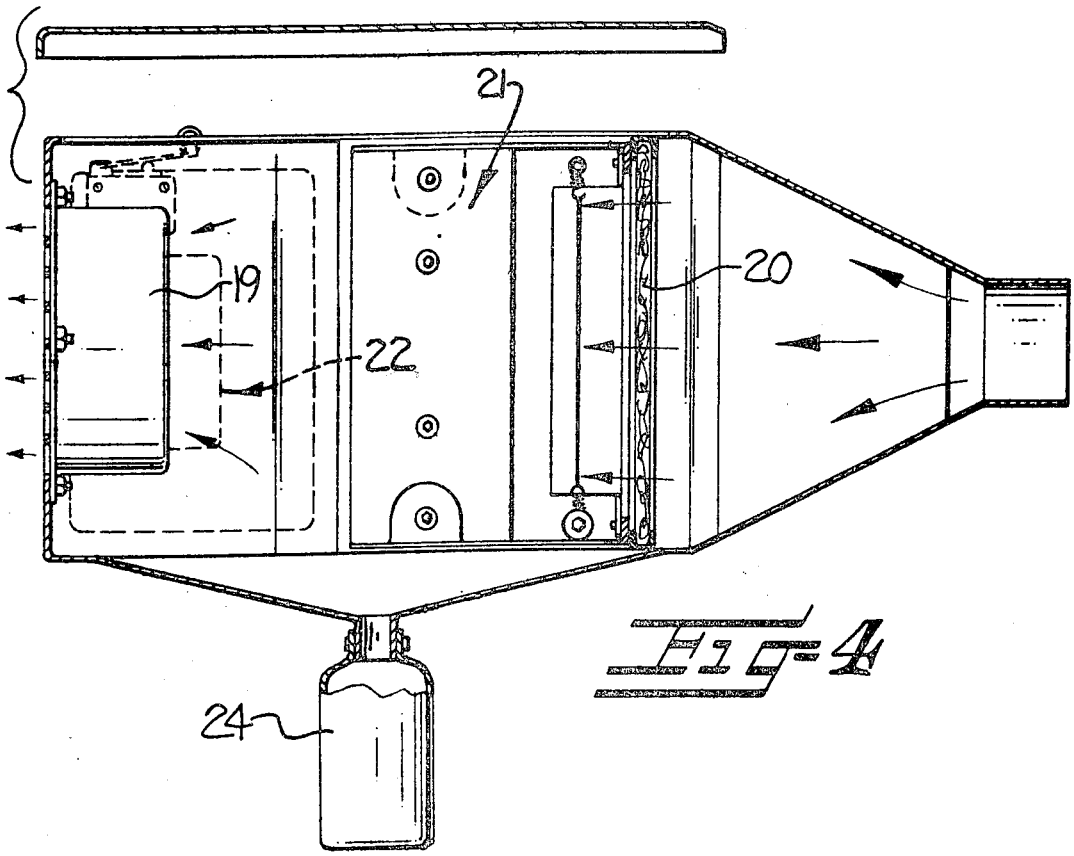
FIG. 4 is a sectional view through the apparatus of FIG. 3, taken generally as indicated by the Line 4—4 in that figure.
Figure 5:
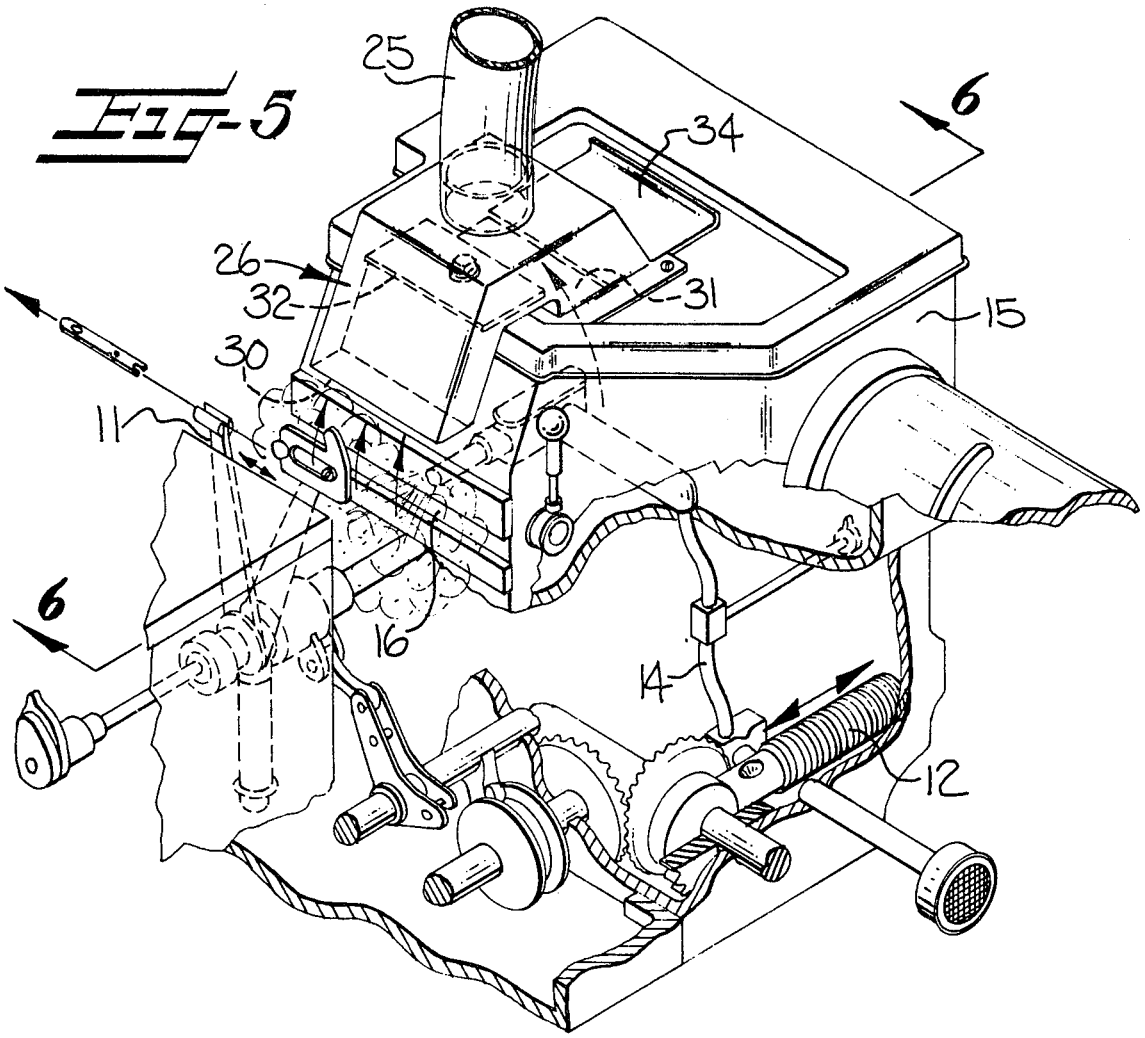
FIG. 5 is an enlarged perspective view similar to FIG. 2, showing a portion of the fabric forming machine equipped in accordance with the present invention.
Figure 6:
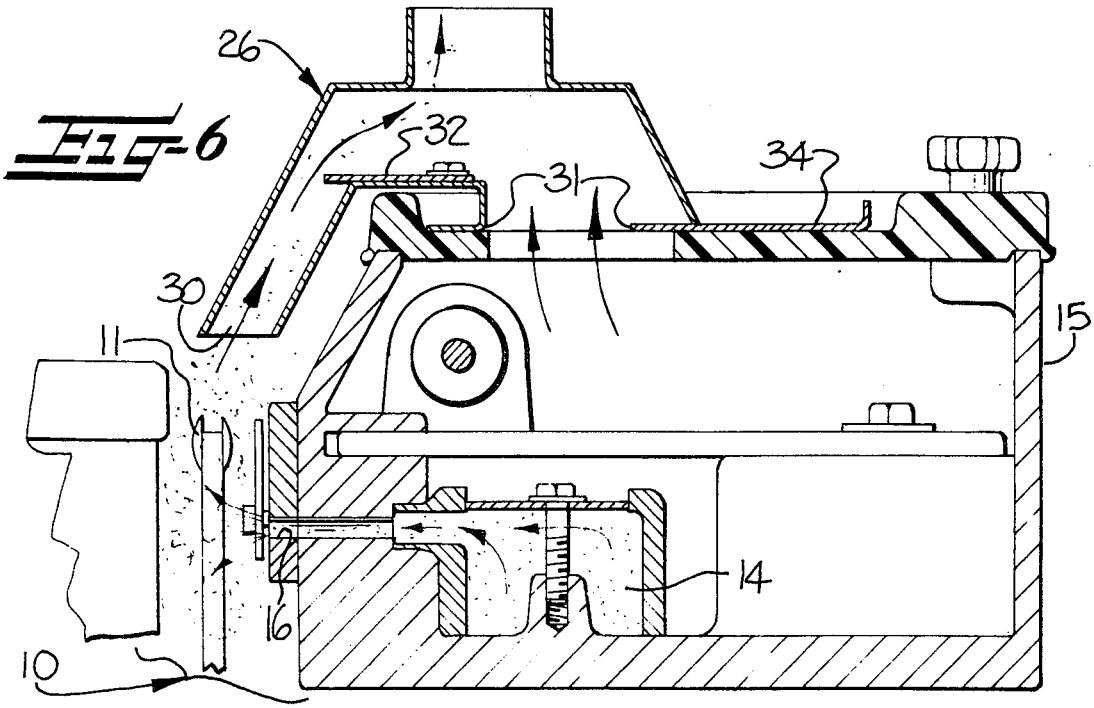
FIG. 6 is a sectional view through portions of the apparatus shown in FIG. 5, taken generally along the Line 6—6 in that figure.

While this invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Referring now more particularly to the accompanying drawings, a textile fabric forming machine is thereshown and generally indicated at 10. In the form shown, the machine 10 is a weaving machine of the type offered commercially by Sulzer, and has weaving instrumentalities for interweaving textile strand materials into fabric. The weaving instrumentalities include appropriate warp strand beams for supplying warp yarns, shedding means for forming the warp yarns into warp sheds, and picking instrumentalities for inserting weft yarns into the warp sheds. The specific details of such portions of a Sulzer weaving machine 10 will be known to persons skilled in the appropriate arts and can be determined by the interested reader from catalogues and descriptions available in previously granted patents, to which the interested reader is referred. To any extent necessary to a full understanding of the present invention, such prior Sulzer patents are hereby incorporated by reference hereinto.

The picking instrumentalities of the weaving machine 10 may include a weft carrier throwing arm 11 together with appropriate means for driving the arm 11 to insert weft yarns. The throwing arm 11 and associated mechanism are lubricated by means incorporated in the machine 10 and taking at least two forms. First, an air pump 12 is provided and operated by appropriate mechanism forming a portion of the machine 10. The air pump 12 draws air from the atmosphere ambient to the machine 10 and forces the air through a delivery duct 14. In a manner forming no part of the present invention, air moving through the delivery duct 14 has oil entrained thereinto in the form of fine particles, so that airborne fine particles are conveyed through the delivery duct 14.

The delivery duct 14 passes through a portion of an enclosure means 15 which encloses at least a portion of the picking instrumentalities of the machine 10. Portions of the picking instrumentalities within the enclosure means 15 may be lubricated by an oil bath or by oil mist supplied through the delivery duct 14. Oil mist supplied through the delivery duct 14 is directed toward the throwing arm 11 and associated mechanism through a slot outlet 16 formed in the enclosure. It is the delivery of airborne fine particles of lubricant through the slot outlet 16 which has heretofore led to problems of contamination of areas ambient to the weaving machine 10.

In accordance with the present invention, means are provided for inducing an airstream to flow adjacent the fabric forming instrumentalities of the machine 10, and particularly the picking instrumentalities, and for entraining in the airstream fine particles of lubricant. The fine particles of lubricant are thus gathered and conveyed from areas adjacent the throwing arm 11 before contamination of areas ambient to the machine 10 may occur. Means are additionally provided for collecting from the airstream the fine particles of lubricant entrained therein.

More specifically, the present invention contemplates mounting on each of a plurality of weaving machines in a weaving shed a housing generally indicated at 18, mounted on a frame of the machine 10 in spaced relation to the picking instrumentalities including the throwing arm 11. Means, shown in the form of a fan 19, are provided in the housing 18 for inducing a suction airstream to flow through the housing 18. The housing 18 additionally encloses filter means in the form of a mechanical prefilter 20 and an electrostatic filter generally indicated at 21 which is supplied with appropriate electrical current of desired currents and voltages by a power supply generally indicated at 22. The prefilter means 20 preferably takes the form of a suitable mechanical filter formed of screen or fibrous filter media, as known to persons skilled in the appropriate arts. The electrostatic filter means 21 preferably takes the form of charging wires subjected to a potential of approximately 13,000 volts and adjacent collector plates of opposite polarities subjected to potentials of approximately 6,000 volts, so that airborne fine particles of lubricant reaching the electrostatic filter means 21 are first electrically charged and then attracted to a collector plate of appropriate charge. Air discharged from the filter may be either negatively or positively charged, with the latter being preferred. Particles of lubricant attracted to a collector plate drain therefrom within the housing 18 and the lubricant eventually is received by a reservoir means such as a jar 24 operatively communicating with the interior of the housing 18 for collecting lubricant precipitated by the filter means.

Duct means, preferably in the form of a flexible conduit member 25, extends from the housing 18 to a hood means generally indicated at 26 for opening operative communication therebetween and delivering an airstream into the housing 18. The hood means 26 is mounted adjacent the picking instrumentalities of the machine 10, to permit the fan 19 to induce air to flow from a localized area adjacent the picking instrumentalities and thereby entrain and remove from that area airborne fine particles of lubricant. More particularly, the hood 26 is mounted on the upper surface of the enclosure means 15 and includes a depending forward wall which defines an inlet 30 opening downwardly adjacent the enclosure means 15 and just above the slot outlet 16. The hood 26 additionally has a secondary opening 31 which mates with an opening in the lid for the enclosure means 15 so as to subject the interior of the enclosure means 15 to a slight negative pressure, for purposes of maintaining a slight inward flow of air thereinto. Damper means in the form of primary and secondary damper members respectively indicated at 32 and 34, control the volume rates of flow through the inlet 30 and the secondary opening 31, respectively. By controlling the position of the primary and secondary damper members 32, 34, a desired flow rate of air and distribution thereof between the inlet 30 and secondary opening 31 may be achieved to assure entraining oil mist.

In use, the throwing arm 11 and other components of the picking instrumentalities forming portions of the fabric forming instrumentalities are lubricated by an oil mist generated by the air pump 12 and delivered through the delivery duct 14 and slot outlet 16. By operation of the fan 19, a flow of air is drawn from a localized area adjacent the throwing arm 11 into the inlet 30 of the hood 26, to pass through the conduit 25 to the housing 18. Such an induced flow of air entrains airborne fine particles of lubricant and exerts a negative pressure within the enclosure means 15. Airborne fine particles of lubricant conveyed to the housing 18 are collected from the airstream by the prefilter means 20 and the electrostatic filter means 21, to be collected within the jar 24.

In the drawings and specification, there has been set forth a preferred embodiment of the invention, and although specific terms are employed, they are used in a generic and descriptive sense only and not for purposes of limitation.

That which is claimed:

1. In a textile fabric weaving machine having weaving instrumentalities for interweaving textile strand materials into fabric, and means for lubricating the weaving instrumentalities with airborne fine particles of lubricant, the improvement comprising means mounted on said machine for inducing an airstream to flow adjacent said weaving instrumentalities and for entraining in the airstream airborne fine particles of the lubricant, and (electrostatic filter) means for removing from the airstream and collecting lubricant entrained therein including electrostatic means for precipitating the entrained fine particles of lubricant from the airstream, whereby contamination of areas ambient to the weaving machine by airborne fine particles of lubricant is controlled.

2. Apparatus according to claim 1 wherein said airstream inducing means comprises hood means mounted on said machine adjacent said weaving instrumentalities and means mounted on said machine remotely from said hood means for drawing suction on said hood means and thereby inducing the airstream to flow from a localized area adjacent said hood means thereinto, whereby airborne fine particles of lubricant emitted into said localized area are drawn into said hood means and conveyed to said collecting means.

3. In a textile fabric weaving machine having picking instrumentalities for inserting weft yarns into warp sheds, and means for lubricating the picking instrumentalities with airborne fine particles of lubricant, the improvement comprising fan means mounted on said machine for inducing a suction airstream to flow, hood means mounted on said machine adjacent said picking instrumentalities and operatively communicating with said fan means for inducing air to flow from a localized area adjacent said picking instrumentalities, and filter means interposed between said fan means and said hood means for removing from the airstream airborne fine particles of the lubricant entrained therein and conveyed thereby from the localized area, whereby contamination of areas ambient to the picking instrumentalities by airborne fine particles of lubricant is controlled.

4. Apparatus according to claim 3 further comprising housing means for containing said fan means and said filter means and being mounted on said machine remotely from said hood means.

5. Apparatus according to claim 3 further comprising reservoir means operatively communicating with said filter means for collecting lubricant removed from the airstream by said filter means.

6. Apparatus according to claim 3 wherein said weaving machine further has enclosure means for enclosing at least a portion of said picking instrumentalities and further wherein said hood means operatively communicates with said enclosure means for drawing a negative air pressure therewithin.

7. Apparatus according to claim 6 wherein said hood means comprises wall means defining an inlet opening downwardly adjacent said enclosure means, and further comprising damper means cooperating with said hood means for apportioning suction air flow between said inlet and said enclosure means.

8. Apparatus according to claim 3 wherein said filter means comprises mechanical prefilter means.

9. Apparatus according to claim 3 wherein said filter means comprises electrostatic filter means for precipitating entrained fine particles of lubricant from the airstream.

10. Apparatus according to claim 3 wherein said filter means comprises mechanical prefilter means and electrostatic filter means arranged for series flow of the airstream successively through the mechanical prefilter means and then the electrostatic filter means.

11. A textile fabric weaving machine equipped to minimize contamination of ambient areas by lubricant and comprising frame means, means mounted on said frame means for interweaving textile strand materials into fabric and including picking instrumentalities, oil mist lubricating means mounted adjacent said interweaving means for lubricating said picking instrumentalities with airborne fine particles of lubricant, housing means mounted on said frame means in spaced relation to said picking instrumentalities, fan means mounted in said housing means for inducing a suction airstream to flow, electrostatic precipitator filter means mounted in said housing means for precipitating from the airstream fine particles of lubricant, reservoir means operatively communicating with said filter means for collecting lubricant precipitated by said filter means, duct means operatively communicating with said housing means for delivering the airstream thereto, and hood means mounted adjacent said picking instrumentalities and operatively communicating with said duct means for inducing air to flow from a localized area adjacent said picking instrumentalities and thereby for entraining and removing from said area airborne fine particles of lubricant.

12. A method of reducing contamination of areas ambient to a textile fabric weaving machine having weaving instrumentalities lubricated with airborne fine particles of lubricant comprising inducing an airstream to flow from adjacent the weaving instrumentalities to a location on the machine spaced from the weaving instrumentalities, entraining airborne fine particles of the lubricant in the airstream while conveying the entrained fine particles of lubricant to the spaced location, electrostatically charging the conveyed fine particles of lubricant and removing the charged fine particles of lubricant from the airstream at the spaced location.

13. A method according to claim 12 wherein the weaving machine has an oil mist lubricating system for the weaving instrumentalities and further wherein said inducing of an airstream comprises drawing a flow of air from a localized area adjacent the weaving instrumentalities.

14. A method of reducing contamination of areas ambient to a textile fabric weaving machine having picking instrumentalities lubricated with airborne fine particles of lubricant and inserting weft yarns into warp sheds, the method comprising inducing an airstream to flow from a localized area adjacent the picking instrumentalities to a location on the machine spaced from the picking instrumentalities, entraining airborne fine particles of the lubricant in the airstream while conveying the entrained fine particles of lubricant to the spaced location, electrostatically filtering the conveyed fine particles of lubricant from the airstream at the spaced location, and returning the filtered airstream to the ambient areas.

15. A textile fabric weaving machine equipped to minimize contamination of ambient areas by lubricant and comprising frame means, means mounted on said frame means for interweaving textile strand materials into fabric and including picking instrumentalities, means mounted on said frame for supplying air atomized oil mist and for delivering oil mist adjacent said interweaving means for lubricating said picking instrumentalities with airborne fine particles of lubricant, housing means mounted on said frame means in spaced relation to said picking instrumentalities, means operatively associated with said housing means for inducing an airstream to flow therethrough, filter means mounted in said housing means and including mechanical prefilter means and electrostatic filter means arranged for series flow of the airstream successively through the mechanical prefilter means and then the electrostatic filter means for removing from the airstream airborne fine particles of the lubricant, reservoir means operatively communicating with said filter means for collecting lubricant removed by said filter means, duct means operatively communicating with said housing means for delivering the airstream thereto, and hood means mounted adjacent said picking instrumentalities and operatively communicating with said duct means for inducing air to flow from a localized area adjacent said picking instrumentalities and thereby for entraining and removing from said localized area airborne fine particles of the lubricant.

* * * * *

UNITED STATES PATENT AND TRADEMARK OFFICE

CERTIFICATE OF CORRECTION

PATENT NO. : 4,117,869

DATED : October 3, 1978

INVENTOR(S) : Reginald Rushman

It is certified that error appears in the above-identified patent and that said Letters Patent are hereby corrected as shown below:

Column 4, Line 42 delete "(electrostatic filter)".

Signed and Sealed this

*Fifth* Day of *June 1979*

[SEAL]

*Attest:*

RUTH C. MASON
*Attesting Officer*

DONALD W. BANNER
*Commissioner of Patents and Trademarks*